US007762200B2

(12) United States Patent
Fischer et al.

(10) Patent No.: US 7,762,200 B2
(45) Date of Patent: Jul. 27, 2010

(54) METHOD FOR STARTING HIGH-PERFORMANCE ENTRAINED FLOW GASIFICATION REACTORS WITH COMBINATION BURNER AND MULTIPLE BURNER ARRAY

(75) Inventors: Norbert Fischer, Lichtenberg (DE); Manfred Schingnitz, Freiberg (DE)

(73) Assignee: Siemens Aktiengesellschaft, München (DE)

( * ) Notice: Subject to any disclaimer, the term of this patent is extended or adjusted under 35 U.S.C. 154(b) by 479 days.

(21) Appl. No.: 11/580,097

(22) Filed: Oct. 12, 2006

(65) Prior Publication Data

US 2008/0000404 A1 Jan. 3, 2008

(30) Foreign Application Priority Data

Jun. 28, 2006 (DE) ..... 10 2006 030 079

(51) Int. Cl.
*F23G 5/12* (2006.01)
*F23G 5/00* (2006.01)

(52) U.S. Cl. ..... 110/347; 110/229; 431/6

(58) Field of Classification Search ..... 110/347, 110/263; 431/6, 284
See application file for complete search history.

(56) References Cited

U.S. PATENT DOCUMENTS 4,113,445 A * 9/1978 Gettert et al. ..... 48/197 R
4,173,189 A * 11/1979 Cooper ..... 110/263
4,316,420 A * 2/1982 Kochey ..... 110/347
4,438,707 A * 3/1984 Delaplace et al. ..... 110/263
4,474,120 A * 10/1984 Adrian et al. ..... 110/347
4,552,076 A * 11/1985 McCartney ..... 110/347
4,881,949 A * 11/1989 Brungel et al. ..... 48/197 R
5,145,491 A * 9/1992 Schmitt et al. ..... 48/197 R
5,156,100 A * 10/1992 Pentti ..... 110/347

* cited by examiner

*Primary Examiner*—Kenneth B Rinehart
*Assistant Examiner*—David J. Laux
(74) *Attorney, Agent, or Firm*—Collard & Roe, P.C.

(57) ABSTRACT

A method for starting high-performance entrained flow gasification reactors with a combination burner or a plurality of pulverized fuel burners, and an ignition and pilot burner. The ignition and pilot burner is ignited, substoichiometrically with fuel gas and a gasifier containing free oxygen. The reactor is brought to the pressure intended and a flow of a fuel gas is supplied with a partial flow of the gasification agent at a substoichiometric ratio through the fuel lines leading to the fuel burner and ignited by the flame of the ignition and pilot burner with a partial flow of the gasification agent. Next, the pulverized fuel is supplied together with a further oxygen-containing gasifying agent through the supply lines to the pulverized fuel burner and is ignited by the flame of the ignition and pilot burner and by the fuel gas flames of the combustible gas generated at the pulverized fuel burner.

7 Claims, 2 Drawing Sheets

METHOD FOR STARTING HIGH-PERFORMANCE ENTRAINED FLOW GASIFICATION REACTORS WITH COMBINATION BURNER AND MULTIPLE BURNER ARRAY

BACKGROUND OF THE INVENTION

1. Field of the Invention

The invention relates to a method for starting high-performance entrained flow gasification reactors. The method finds application in high-performance entrained flow gasifiers having an output of >200 MW, as they may be utilized for synthesis gas supply of large-scale synthesis facilities. While ensuring technical safety and short startup time, the invention allows starting the autothermal partial oxidation of pulverized fuels such as lignite and hard coal, petroleum coke, solid grindable carbon-containing residues but also solid-liquid suspensions, called slurries, with an oxygen-containing gasification agent at operating pressures of up to 100 bar.

2. The Prior Art

The configuration of a device for pulverized fuel supply inclusive of the supply lines and their association with the pulverized fuel burners as well as the arrangement of the burners on the reactor head for entrained flow gasifiers are described in German Patent No. DE 10 2005 048 488.3. This document discloses a method for gasifying pulverized fuels in which solid fuels are converted in the entrained flow with an oxidation agent containing free oxygen through partial oxidation at pressures ranging between ambient pressure and 80 bar and at temperatures ranging between 1,200 and 1,900° C. at high reactor performances ranging between 500 MW and 1,500 MW. The method consists of the partial technologies: dosing the fuel, gasification reaction in a gasification reactor with cooled reaction chamber contour, quench cooling, raw gas scrubbing, partial condensation. A fuel, preferably a pulverized fuel, containing having a moisture content of <10 wt.-% and a grain size of <200 μm, is given into a plurality of synchronized dosing systems that supply the fuel, preferably the pulverized fuel, through supply pipes to a plurality of gasification burners disposed on the head of a reactor. The burners are disposed symmetrically and containing additional oxygen feed lines.

Further, the method finds application in plants, in which pulverized fuel flows, preferably three pulverized fuel flows, flow from a bin to pressurized lock hoppers that lead the pulverized fuel flows to feeder vessels from which one or preferably three supply lines lead to preferably three pulverized fuel burners in a gasification reactor.

The high-performance reactor has a plurality of gasification burners symmetrically disposed at the head thereof and an ignition and pilot burner.

German Patent No. DD 278692 describes a method for starting reactors with a water-cooled tube wall construction. It explains that the gasification materials are ignited at full operating pressure, and the thermal output Q delivered by the ignition and pilot burner have to be greater than or equal to the required ignition heat QZ needed by the starting amount of gasification material corresponding to the minimum permanent output of the production pulverized fuel burner(s) if one wants to achieve reliable and instantaneous ignition directly before and during the startup of the production pulverized fuel burner(s). The disadvantage thereof is that the thermal output performance of the ignition and pilot burner must be very high with high-performance gasification reactors of up to 1,500 MW.

SUMMARY OF THE INVENTION

It is therefore an object of the invention to provide a method for starting high-performance entrained flow gasification reactors of >200 MW for the autothermal partial oxidation of pulverized fuels such as lignite and hard coal, petroleum coke, solid grindable carbon-containing residues but also solid-liquid suspensions, called slurries, at operating pressures of up to 100 bar with at reduced thermal output performance of the ignition and pilot burner.

This object is accomplished by a method for starting high-performance entrained flow gasification reactors with a combination burner containing an ignition and pilot burner as well as a pulverized fuel burner or a multiple burner array, with a plurality of pulverized fuel burners being disposed separately about around an ignition and pilot burner for autothermal partial oxidation of pulverized solid fuels such as lignite and hard coal, petroleum coke or solid grindable carbon-containing residues that are pneumatically supplied to the combination burner with an oxygen-containing gasifying agent at operating pressures of up to 100 bar and temperatures ranging between 1,200° C. and 1,800° C. by means of an ignition flame. The ignition and pilot burner is ignited substoichiometrically with a fuel gas and the oxygen-containing gasification means. The entrained flow gasification reactor is thus brought to the pressure intended, and an intended flow of a fuel gas is thereafter supplied with a partial flow of the oxygen-containing gasification agent at a substoichiometric ratio through the pulverized fuel lines leading to the pulverized fuel burner and ignited by the flame of the ignition and pilot burner. Next, the pulverized fuel for partial oxidation is supplied together with further oxygen-containing gasifying agents through the supply lines to the pulverized fuel burner and is ignited by the flame of the ignition burner and by the fuel gas flames at the pulverized fuel burner.

In principle, the method of the invention is applicable to various burner arrays in reactors.

The ignition and pilot burner is disposed in the center, i.e., in the center of the vertical axis of the gasification reactor. The ignition and pilot burner can be disposed in the center of a burner, for example a pulverized fuel burner, so that a combination burner is provided. The ignition and pilot burner may however also be disposed in the center between pulverized fuel burners. The pulverized fuel burners may for example be staggered about the central ignition and pilot burner.

The centrally disposed ignition and pilot burner is ignited with a high-voltage ignition device. Immediately thereafter, the output of the ignition and pilot burner and the pressure of the entrained flow gasification reactor, inclusive of the downstream raw gas system, is increased to the maximum ignition and pilot burner performance and to the operating pressure of the plant.

Once the operating pressure has been achieved, fuel gas is supplied through one or a plurality of pulverized fuel supply lines and burned together with an oxygen-containing gasification agent supplied at a substoichiometric ratio through separate lines.

Once the operating pressure has been achieved, the fuel gas flowing into the gasification reactor through the pulverized fuel supply lines is added and ignited. If three separate pulverized fuel burners are provided, they are supplied with combustible fuel gas through pulverized fuel supply lines and with an oxygen-containing gasification agent supplied at a substoichiometric ratio through separate lines. When the mixture of combustible fuel gas and pulverized fuel is ignited, the starting conditions for supplying the pulverized fuels such as lignite and hard coal, petroleum coke, solid grindable carbon-containing residues but also solid-liquid suspensions to the entrained flow reactor are fulfilled. The supply of gasification material is started by successive connection of only one supply line at a time in such a manner that after the supply line has been connected, an apportioned flow of gasification agent corresponding to the selected λ ratio is added first, with the next fuel line being connected thereafter only. With a multiple burner array, one or a plurality of combustible fuel lines may be activated one after the other for each burner. Not yet connected combustible fuel lines will then be connected in an analogous fashion.

With this way of proceeding, if the igniting flame is to reliably and instantaneously ignite the fuel immediately before and during startup of the burner(s), the igniting heat provided should merely correspond to the minimum permanent output of a combustible fuel supply pipe. Using the method and utilizing a combination burner, the need for ignition heat can be reduced by 60%, and utilizing a multiple burner array, by up to 90%.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
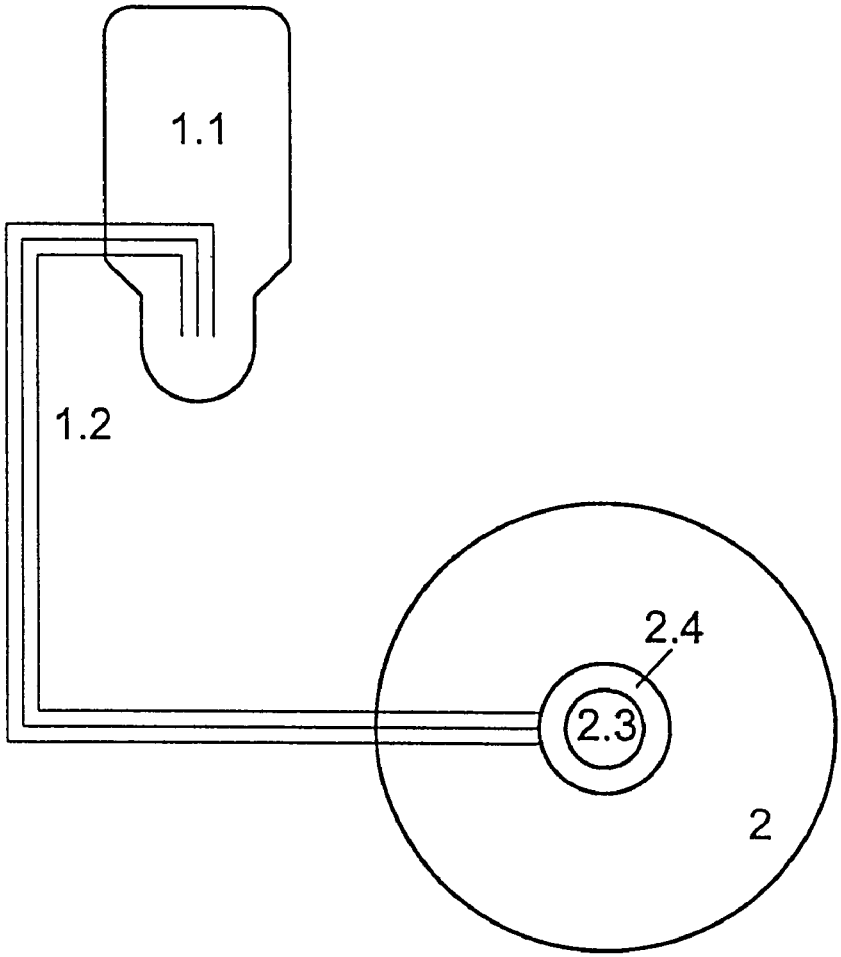
FIG. 1 shows a pulverized fuel feeder vessel with pulverized fuel supply lines for supplying pulverized fuel to the gasification reactor having a combination burner.

The first example intended to provide a better understanding of the invention is a gasification reactor with a combination burner as shown in FIG. 1. The combination burner, which is attached to the head of reactor 2, consists of the ignition and pilot burner with ignition device 2.3 and pulverized fuel burner part 2.4. For supplying the pulverized fuel burner with pulverized fuel, the amount of pulverized fuel needed is supplied through three supply lines 1.2 from a feeder vessel 1.1.

With a gasification reactor 2 with a gross output of 500 MW and combination burner 2.4 described, this corresponds to an amount of pulverized coal of 78 Mg/h. The pulverized fuel has a heating value of 23 MJ/kg. Pulverized fuel is supplied from feeder vessel 1.1 to combination burner 2.4 by means of the three supply lines 1.2 mentioned, that is to say 26 Mg/h per line. The maximum initial output of fuel line 1.2 is 11.7 Mg/h. This initial output results in a minimum ignition heat of 13.5 GJ/h. In the prior art, a minimum ignition heat of 40.5 GJ/h would be necessary at startup.

After the operating pressure in reactor 2 and the ignition output of the ignition and pilot burner 2.3 is achieved, pulverized fuel burner 2.4 is started in such a manner that the automatic control unit causes fuel gas and oxygen-containing gasification agent to be supplied to pulverized fuel burner 2.4 so that the igniting flame of ignition and pilot burner 2.3 first causes a fuel gas-oxygen flame to ignite at each of three pulverized fuel supply lines 1.2. The amount of fuel gas and of oxygen is monitored by a higher order safety system. The sensed heat quantity released by the ignition burner flame and the three combustible fuel gas-oxygen flames at pulverized fuel burner 2.4 is so high that it is ensured that the 11.7 Mg/h pulverized coal flowing into reactor 2 will ignite by means of the automatic control unit causing the first supply line 1.2 to open and the oxygen-containing gasification agent to increase. After that, the second and third pulverized coal supply lines 1.2 are started. The amount of fuel gas, of pulverized coal and of oxygen is monitored by the higher order safety system. Once pulverized coal burner 2.4 has been started, the supply of fuel gas to the pulverized coal burner 2.4 is stopped.

Another example is described with the same burner. Ignition and pilot burner 2.3 is ignited in the same manner as in Example 1. Once the ignition and pilot burner has reached its full output and the desired pressure in gasification reactor 2 has been achieved, the amount of fuel gas corresponding to the necessary minimum ignition heat required of 13.5 MJ/h is added through a pulverized fuel supply pipe 1.2 and ignited with an oxygen-containing gasification agent. Once the flame is stable, the other two pulverized fuel lines 1.2 are immediately brought to react with the solid fuel or slurry and the oxygen-containing oxidation agent. Next, these three pulverized fuel lines 1.2 are adjusted upward to the nominal output of 26 Mg/h per line.

Figure 2:
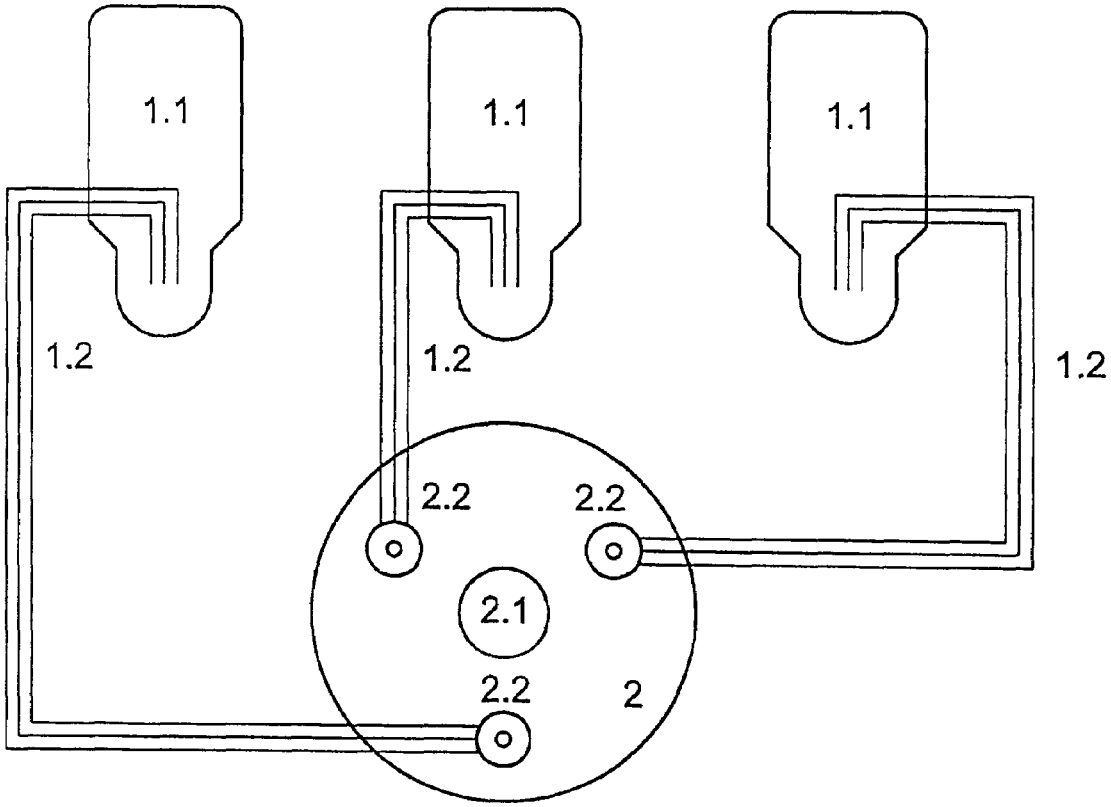
FIG. 2 shows a pulverized fuel feeder vessel with pulverized fuel supply lines for supplying pulverized fuel to the gasification reactor having a multiple burner array.

In a third example, the method will be described with gasification reactors having a multiple burner array as shown in FIG. 2. A carbon pulverized coal amount of 240 Mg/h is supplied to a gasification reactor 2 with a gross output of 1.500 MW as shown in FIG. 2. The pulverized fuel has a heating value of 24.7 MJ/kg. At the head of gasification reactor 2 in which the pulverized hard coal is gasified with a gasification agent containing free oxygen, there are mounted an ignition and pilot burner 2.1 and three pulverized coal burners 2.2 that are staggered 120° apart about the ignition and pilot burner. Pulverized coal burners 2.2 are each loaded from one feeder vessel 1.1, each unit supplying ⅓ of the total amount of pulverized fuel, that is 80 Mg/h into reactor 2 by means of three respective supply lines 1.2, that is 26.7 Mg/h per line. The initial output of a supply line 1.2 is 12 Mg/h. Based on this initial output of line 1.2, a minimum ignition heat of only 14.8 GJ/h is needed as compared to the 133.4 GJ/h needed with the prior art method. Once the operating pressure in reactor 2 and the ignition output of the ignition and pilot burner 2.1 are achieved, the three pulverized coal burners 2.2 are started in such a manner that fuel gas and an oxygen-containing gasification agent are supplied to pulverized coal burners 2.2 through the automatic control unit so that the ignition flame of ignition and pilot burner 2.1 causes at first a fuel gas-oxygen flame to ignite at each of the three pulverized coal burners 2.2. The amount of fuel gas and of oxygen is monitored by a higher order safety system. The sensed heat quantity released by the flame of ignition and pilot burner 2.1 and the three fuel gas-oxygen flames at pulverized fuel burners 2.2 is so high that it ensures that the 12 Mg/h pulverized coal flowing into reactor 2 will ignite by means of the automatic control unit, causing first supply line 1.2 to open and the oxygen-containing gasification agent to increase.

Thereafter, a pulverized coal supply line 1.2 of the second pulverized coal burner 2.2 is started with increased gasification agent and then, of the third carbon pulverized coal burner 2.2. Startup is continued in the sequence described until all pulverized coal supply lines 1.2 are in operation. The amount of combustible fuel gas, pulverized coal and oxygen is monitored by the higher order safety system. Once the pulverized coal burners 2.2 are in operation, the supply of fuel gas to pulverized coal burners 2.2 is stopped.

In a fourth embodiment, gasification reactor 2 is started with the aid of ignition and pilot burner 2.1 in a manner analogous to example 3. Once the desired operation pressure and full ignition and pilot burner output are achieved, the amount of fuel gas corresponding to a thermal output of 14.8 GJ/h is supplied through one of the three carbon pulverized coal burners 2.2 and burned substoichiometrically. Next, the other two pulverized coal burners 2.2 are started with pulverized coal, one supply pipe 1.2 being first supplied with the minimum amount of pulverized fuel of 12 Mg/h and then the other two supply pipes 1.2, also with 12 Mg/h each. After burners 2.2 have reached the minimum starting amount of 3×12=36 Mg/h each, they are adjusted upward to the operating performance of 80 Mg/h for each burner 2.2. In a comparable manner, burner 2.2, which is at first supplied with fuel gas, is brought to a performance of 80 Mg/h by stopping the fuel gas supply.

In a fifth embodiment, the method for gasification reactors 2 for slurry gasification having a combination burner and a multiple burner array will be illustrated, as shown in FIG. 2. In place of the dry pneumatic pulverized fuel supply described in examples 1-4, the pulverized fuel for certain fuels such as hard coal, petroleum coke and solid grindable carbon-containing residues can be introduced into the gasification reactor in the form of a pulverized fuel-water or pulverized fuel-oil suspension, called slurry. For a reactor 2 with an output of 500 MW and, as a result thereof, a pulverized fuel need of 78 Mg/h, the amount to be supplied at a solids concentration of 60 wt.-% in the slurry comes up to 130 Mg/h. The minimum ignition heat is 13.56 MJ/h like in Example 1, which corresponds to a slurry amount of 20 Mg/h. The startup process itself takes place as in the previously described examples.

Accordingly, while only a few embodiments of the present invention have been shown and described, it is obvious that many changes and modifications may be made thereunto without departing from the spirit and scope of the invention.

List of the Numerals Used

1.1 pulverized fuel feeder vessel
1.2 pulverized fuel supply lines
2 gasification reactor
2.1 ignition and pilot burner
2.2 pulverized fuel burner
2.3 ignition and pilot burner of the combination burner
2.4 pulverized fuel burner of the combination burner

What is claimed is:

1. A method for starting a high-performance entrained flow gasification reactor with a combination burner containing an ignition and pilot burner and at least one pulverized fuel burner at a top of the reactor, for autothermal partial oxidation of pulverized solid fuels such as lignite and hard coal, petroleum coke or solid grindable carbon-containing residues, wherein for each fuel burner there are a plurality of fuel supply lines arranged for supplying an amount of pulverized fuel to the pulverized fuel burner with an oxygen-containing gasifying agent at operating pressures of up to 100 bar and temperatures ranging between 1,200° C. and 1,800° C. by means of an ignition flame, the method comprising the following steps in order:

igniting the ignition and pilot burner substoichiometrically with a fuel gas and the oxygen-containing gasifying agent;

bringing the entrained flow gasification reactor to a selected pressure of up to 100 bar;

supplying through at least one of the plurality of fuel supply lines a flow of the fuel gas to the pulverized fuel burner;

supplying an oxygen-containing gasification agent for the fuel gas at a substoichiometric ratio through a separate line to the pulverized fuel burner;

igniting the fuel gas with a flame of the ignition and pilot burner;

supplying the pulverized fuel together with further oxygen-containing gasifying agents through the fuel supply lines to the pulverized fuel burner, wherein the fuel supply lines are activated in successive steps only one supply line at a time in such a manner that after one of the fuel supply lines has been activated, an appropriate flow of gasification agent corresponding to a selected substoichiometric λ ratio is added first, with a next fuel supply line being activated only after igniting the pulverized fuel of a previously activated fuel supply line by the flame of the ignition and pilot burner and by fuel gas flames at the pulverized fuel burners.

2. The method according to claim 1, wherein the pulverized fuel is supplied as a pulverized fuel-water or pulverized fuel-oil suspension.

3. The method according to claim 1, wherein an amount of heat needed for ignition of the pulverized fuel is approximately .05 to 0.5 times a product of the pulverized fuel mass flow of one supply line only and its heating value.

4. The method as set forth in claim 1, wherein the amount of fuel gas and of oxygen in the reactor is monitored by a higher order, independent, automatically acting safety system.

5. A method for starting a high-performance entrained flow gasification reactor with an ignition and pilot burner and a plurality of burners separately disposed around the ignition and pilot burner, all of said burners being arranged at a top of the reactor, for autothermal partial oxidation of pulverized solid fuels such as lignite and hard coal, petroleum coke or solid grindable carbon-containing residues, wherein for each fuel burner there are a plurality of fuel supply lines arranged for supplying an amount of pulverized fuel to the pulverized fuel burners with an oxygen-containing gasifying agent at operating pressures of up to 100 bar and temperatures ranging between 1,200° C. and 1,800° C. by means of an ignition flame, the method comprising the following steps in order:

igniting the ignition and pilot burner substoichiometrically with a fuel gas and the oxygen-containing gasifying agent;

bringing the entrained flow gasification reactor containing free oxygen to a selected pressure of up to 100 bar;

supplying through at least one of the plurality of fuel supply lines a flow of the fuel gas to each pulverized fuel burner;

supplying an oxygen-containing gasification agent for the fuel gas at a substoichiometric ratio through a separate line to the pulverized fuel burner;

igniting the fuel gas with a flame of the ignition and pilot burner;

supplying the pulverized fuel together with further oxygen-containing gasifying agents through the fuel supply lines to each pulverized fuel burner, wherein the fuel supply lines are activated in successive steps only one supply line at a time to each pulverized fuel burner in such a manner that after one of the fuel supply lines has been activated, an appropriate flow of gasification agent corresponding to a selected substoichiometric λ ratio is added first, with a next fuel supply line being activated only after igniting the pulverized fuel of a previously activated fuel supply line by the flame of the ignition and pilot burner and by fuel gas flames at the pulverized fuel burners.

6. A method for starting a high-performance entrained flow gasification reactor with a combination burner containing an ignition and pilot burner and at least one slurry burner arranged at a top of the reactor, for autothermal partial oxidation of slurries, wherein there are a plurality of fuel supply lines arranged for supplying an amount of slurry fuel to the slurry burner with an oxygen-containing gasifying agent at operating pressures of up to 100 bar and temperatures ranging between 1,200° C. and 1,800° C. by means of an ignition flame, the method comprising the following steps in order:

igniting the ignition and pilot burner substoichiometrically with a fuel gas and the oxygen-containing gasifying agent;

bringing the entrained flow gasification reactor containing free oxygen to a selected pressure of up to 100 bar;

supplying through at least one of the plurality of fuel supply lines a flow of the fuel gas to the slurry burner;

supplying an oxygen-containing gasification agent for the fuel gas at a substoichiometric ratio through a separate line to the pulverized fuel burner;

igniting the fuel gas with a flame of the ignition and pilot burner;

supplying the slurry fuel together with further oxygen-containing gasifying agents through the fuel supply lines to the slurry burner, wherein the fuel supply lines are activated in successive steps only one supply line at a time to the slurry burner in such a manner that after one of the fuel supply lines has been activated, an appropriate flow of gasification agent corresponding to a selected substoichiometric λ ratio is added first, with a next fuel supply line being activated only after igniting the slurry fuel in a previously activated fuel supply line by the flame of the ignition and pilot burner and by fuel gas flames at the slurry burner.

7. A method for starting a high-performance entrained flow gasification reactor with a combination burner containing an ignition and pilot burner and a plurality of slurry burners separately disposed around the ignition and pilot burner, all of said burners being arranged at a top of the reactor, for autothermal partial oxidation of slurries, wherein there are a plurality of fuel supply lines arranged for supplying an amount of slurry fuel to each slurry burner with an oxygen-containing gasifying agent at operating pressures of up to 100 bar and temperatures ranging between 1,200° C. and 1,800° C. by means of an ignition flame, the method comprising the following steps in order:

igniting the ignition and pilot burner substoichiometrically with a fuel gas and the oxygen-containing gasifying agent;

bringing the entrained flow gasification reactor containing free oxygen to a selected pressure of up to 100 bar;

supplying through at least one of the plurality of fuel supply lines a flow of the fuel gas to each of the slurry burners;

supplying an oxygen-containing gasification agent for the fuel gas at a substoichiometric ratio through a separate line to the pulverized fuel burner;

igniting the fuel gas with a flame of the ignition and pilot burner;

supplying the slurry fuel together with further oxygen-containing gasifying agents through the fuel supply lines to each of the slurry burners, wherein the fuel supply lines are activated in successive steps only one supply line at a time to each slurry burner in such a manner that after one of the fuel supply lines has been activated, an appropriate flow of gasification agent corresponding to a selected substoichiometric λ ratio is added first, with a next fuel supply line being activated only after igniting the slurry fuel in a previously activated fuel supply line by the flame of the ignition and pilot burner and by fuel gas flames at the slurry burners.

* * * * *